United States Patent [19]

Ault

[11] Patent Number: 4,975,124

[45] Date of Patent: Dec. 4, 1990

[54] PROCESS FOR DENSIFYING CASTINGS

[75] Inventor: Earl A. Ault, South Windsor, Conn.

[73] Assignee: United Technologies Corporation, Hartford, Conn.

[21] Appl. No.: 307,110

[22] Filed: Feb. 6, 1989

[51] Int. Cl.[5] ..... C22F 1/10

[52] U.S. Cl. ..... 148/3; 148/4; 148/131

[58] Field of Search ..... 148/2, 4, 3, 11.5 N, 148/131, 404, 428

[56] References Cited

U.S. PATENT DOCUMENTS

| | | | |
|---|---|---|---|
| 3,279,917 | 10/1966 | Ballard et al. | 75/226 |
| 3,329,535 | 7/1967 | Langer et al. | 148/4 |
| 3,758,347 | 9/1973 | Stalker | 148/4 |
| 3,773,506 | 11/1973 | Larker et al. | 75/226 |
| 4,021,910 | 5/1977 | Freeman, Jr. et al. | 29/526.3 |
| 4,125,417 | 11/1978 | Antony | 148/131 |
| 4,171,562 | 10/1979 | Freeman et al. | 29/530 |
| 4,250,610 | 2/1981 | Wilbers et al. | 29/424 |
| 4,302,256 | 11/1981 | Kenton | 148/4 |
| 4,446,100 | 5/1984 | Adlerborn et al. | 418/48 |
| 4,448,747 | 5/1984 | Moritoki et al. | 419/49 |
| 4,478,789 | 10/1984 | Adlerborn et al. | 419/49 |
| 4,482,398 | 11/1984 | Eylon et al. | 148/421 |
| 4,505,764 | 3/1985 | Smickley et al. | 148/421 |
| 4,612,066 | 9/1986 | Levin et al. | 148/133 |
| 4,624,714 | 11/1986 | Smickley et al. | 148/421 |
| 4,717,432 | 1/1988 | Ault | 148/162 |
| 4,743,312 | 5/1988 | Eridon et al. | 148/131 |

OTHER PUBLICATIONS

Superalloys—Processing MCIC Report 9/72, 28 pages.

Mechanical Behavior and Processing of DS and Single (Journal of Metals 7/86) Crystal Superalloys-T. Khan, P. Caron and Y. G. Nakagawa, 4 pages.

High Temperature Technology, vol. 4, No. 2, May 1986, The Effects of Hipping . . . -Koizumi et al., 5 pages.

Development of Coated . . . -Strangman et al., Conference Proceedings "The Metallurgical Society of AIME", 11 pages.

Anisotropic Fatigue Hardening . . . -Jablonski et al., Scripts Metallurgica, vol. 15, pp. 1003-1006, 1981, 4 pages.

Consolidation Of Metal Powders, 3 pages.

*Primary Examiner*—R. Dean

*Attorney, Agent, or Firm*—James M. Rashid

[57] ABSTRACT

An improved process for hot isostatically pressing metal castings is described. The key feature of the invention relates to the continual increase in the magnitude of the applied pressure during the cycle, and the absence of holds at pressure after achieving the maximum process pressure.

10 Claims, 1 Drawing Sheet

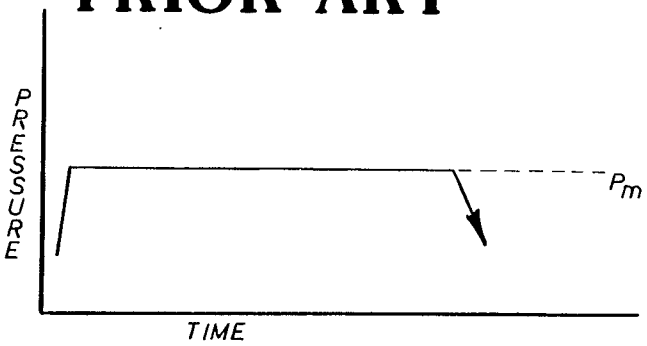
FIG.1
PRIOR ART
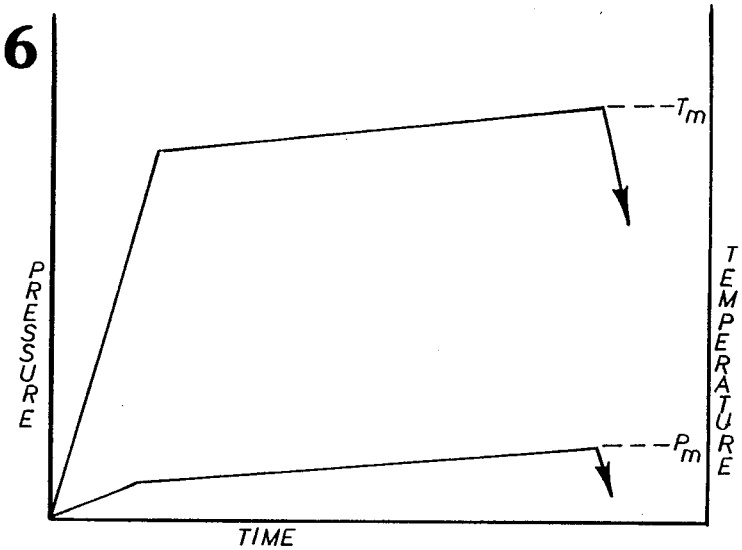
FIG. 6
FIG. 2
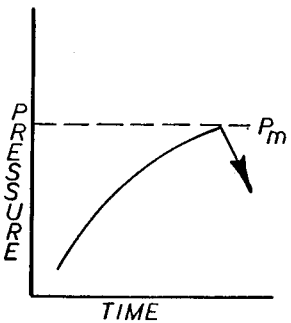
FIG. 3
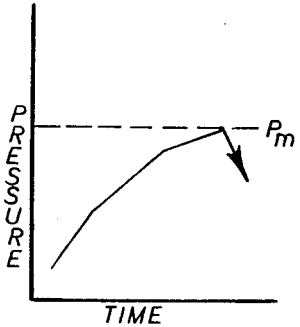
FIG. 4
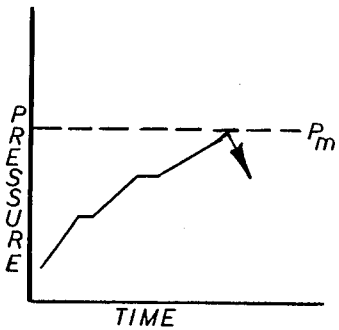
FIG. 5

PROCESS FOR DENSIFYING CASTINGS

TECHNICAL FIELD

This invention relates to techniques for hot isostatic pressing directionally solidified superalloy castings.

BACKGROUND

Directionally solidified (DS) superalloy castings are characterized microstructurally by either a columnar grain or single crystal structure. During the casting process, gas is sometimes entrapped within the casting mold, which can result in the formation of pores in the solidified casting. Researchers have known for some time that the closure of such porosity by hot isostatic pressing (HIP) improves the mechanical properties of DS castings. See, for example, Jablonski and Sargent, "Anisotropic Fatigue Hardening of a Nickel Base Single Crystal at Elevated Temperatures," Scripta Metallurgica, Volume 15, Page 1003, 1981. The HIP process described by Jablonski, et al is typical of the processes generally used throughout the industry, and is characterized by a substantially simultaneous increase of temperature and pressure from ambient conditions to a desired maximum temperature and pressure. The casting being HIP'd is then held at such maximum temperature and pressure for an extended period of time, usually in the range of about 2–10 hours, to close all of the as-cast porosity. The extended period of time at which DS castings are held at elevated temperature and pressure results in a significant addition to the cost of the casting. But, even with extended holds, complete closure of as-cast porosity does not always occur. Further, recrystallization of the casting has been observed to take place with some HIP cycles used in the industry. Recrystallized grains are particularly undesired in HIP'd DS castings, since such grains can act as fatigue fracture initiation sites. As a result of such concerns, the industry needs a HIP process which is less expensive to carry out and less prone to result in recrystallization than processes presently used.

SUMMARY OF THE INVENTION

According to this invention, an improved process for hot isostatically pressing directionally solidified metal castings is characterized by an increase in the magnitude of the applied pressure during the HIP cycle from ambient conditions to a maximum process pressure, followed by a return back to ambient pressure conditions; there is no intentional hold at the maximum process pressure. Preferably, the graph of pressure versus time during the entire cycle has a nonzero slope; once the desired (maximum) pressure is reached, the chamber within which the process takes place is vented, and the casting returns to ambient conditions.

The invention cycle can also include a continual increase in temperature during the HIP cycle.

The foregoing, and other features and advantages of the present invention will become more apparent from the following description and the accompanying drawings.

BRIEF DESCRIPTION OF THE DRAWINGS

FIG. 1 is a graph of pressure versus time of HIP processes of the prior art.

FIGS. 2–5 are graphs of pressure versus time as applied during a HIP process according to this invention.

FIG. 6 is a graph of temperature and pressure versus time during the preferred HIP process.

BEST MODE FOR CARRYING OUT THE INVENTION

The invention is best understood by referring to the figures, which show the prior art processes as well as several embodiments of the invention. FIGS. 2 through 6 show the key feature of the invention, which is the continual increase in pressure throughout the HIP cycle. This is contrary to the prior art process as shown in FIG. 1. The pressure versus time curve of the invention process can have a nonzero slope throughout the entire cycle, or pressure can be held constant for short periods of time during the cycle. However, in all of the invention cycles, the magnitude of the applied pressure is continually increasing to the maximum pressure.

The key feature of the invention is, then, that the magnitude of the applied pressure increases throughout the cycle. Such continual increases in pressure (whether they be continuous or discontinuous) are contrary to the cycles described by the prior art which include lengthy periods of time at a constant pressure. The process according to this invention is best carried out by minimizing the number of holds at constant pressure. As will be discussed below, in the preferred embodiment of the invention, the only intentional hold at constant pressure takes place at the beginning of the HIP cycle after the casting has been heated to an elevated temperature and thermal homogenizations is desired. After the preliminary hold, pressure is increased for the duration of the cycle. And after a predetermined period of time, pressure and temperature are reduced to ambient conditions and the cycle is ended.

The figures show various embodiments of the invention cycle for the alloy known as PWA 1480, which is described in more detail in U.S. Pat. No. 4,209,348 Duhl and Olson. An average PWA 1480 composition is, on a weight percent basis, about 10Cr - 5Co-1.5Ti-5Al-4W-12Ta, balance nickel.

FIGS. 2 through 6 show several ways in which the pressure may be increased during a HIP cycle according to this invention. The figures do not show any preliminary holds at pressure, although such holds are contemplated in certain circumstances as described above. In FIG. 2, pressure is continually raised to a maximum pressure $P_m$. The rate of pressure change is constant (i.e., the pressure increases in a continuous fashion). In FIGS. 3 through 5, the rate at which pressure is increased is nonconstant and changes as a function of time. And in FIG. 5, there are short holds at constant pressure levels; nonetheless, pressure is increased through the cycle.

FIG. 6 shows the preferred process for carrying out the invention: as is shown in the figure, temperature is raised from ambient conditions to about 1,305° C. (about 2,380° F.) during the initial portion of the cycle. The temperature is then raised to a maximum temperature ($T_m$) of about 1,310° C. (about 2,390° F.) during the next three hours. $T_m$ should be no closer than about 20° C. (about 35° F.) from the incipient melting temperature of the component being HIP'd, and it should be greater than the gamma prime solvus temperature. The pressure within the chamber increases to about 35 MPa (about 5 Ksi) during the initial portion of the cycle, primarily as a result of ideal gas law effects. Pressure is then slowly raised to a maximum pressure ($P_m$) of about 155 MPa (about 22.5 Ksi) during the next three hours. The figure shows that when the chamber reaches $T_m$ and $P_m$, a reduction in temperature and pressure begins without any intentional holds.

Castings processed according to the HIP cycle shown in FIG. 6 exhibit no as-cast porosity and no indications of surface or sub-surface recrystallization. Even though FIG. 6 shows that the casting temperature is continually increased to Tm during the HIP cycle, the temperature could be held constant during the majority of the cycle. Continual increases in temperature are described in more detail in commonly assigned U.S. Pat. No. 4,717,432 to Ault, the contents of which are incorporated by reference. The maximum HIP temperature is preferably above the gamma prime solvus temperature, but below the incipient melting temperature.

It will be apparent to those skilled in the art that various modifications and variations can be made in this invention as described, without departing from this scope or spirit of such invention.

I claim:

1. A process for hot isostatically pressing a directionally solidified metal casting comprising the steps of heating the casting to a maximum process temperature, pressurizing the casting to a maximum process pressure, and then returning the casting from said maximum pressure and temperature to ambient temperature and pressure, wherein said pressurizing step is characterized by increasing the pressure of the casting from ambient pressure to said maximum pressure such that there are no intentional holds at said maximum pressure, and wherein said maximum process temperature and maximum process pressure are selected to close as-cast porosity in the casting.

2. The process of claim 1, wherein the pressure increases at a constant rate during said pressurizing step.

3. The process of claim 1, wherein the pressure increases at a nonconstant rate during said pressurizing step.

4. The process of claim 1, wherein said pressurizing step is further characterized by increasing the pressure of the casting from ambient pressure to said maximum pressure such that the graph of pressure versus time prior to reaching said maximum pressure has a nonzero slope.

5. The process of claim 1, wherein the graph of temperature versus time prior to reaching said maximum process temperature has a nonzero slope.

6. The process of claim 4, wherein the graph of temperature versus time prior to reaching said maximum process temperature has a nonzero slope.

7. A process for hot isostatically pressing a directionally solidified metal casting comprising the steps of heating the casting to a maximum process temperature and pressurizing the casting to a maximum process pressure at a rate sufficient to close internal porosity when said maximum process pressure is first reached, wherein there are no intentional holds at said maximum process pressure.

8. The process of claim 8, where the graphs of pressure versus time and temperature versus time both have a nonzero slope.

9. A process for hot isostatically pressing a directionally solidified single crystal casting, comprising the steps of heating the casting to a maximum process temperature and pressurizing the casting to a maximum process pressure such that the magnitude of the applied pressure continually increases during said pressurizing step and there are no intentional holds at said maximum process pressure, and then returning the casting to ambient pressure and temperature, wherein said maximum process temperature and maximum process pressure are selected to close as-cast porosity in the casting.

10. The process of claim 9 wherein said casting has an average composition, on weight percent basis, of about 10Cr-5Co-1.5Ti-5Al-4W-12Ta - balance nickel; said maximum process temperature is about 1,310° C.; and said maximum process pressure is about 155 MPa.

* * * * *